US007999776B2

(12) United States Patent
Li et al.

(10) Patent No.: US 7,999,776 B2
(45) Date of Patent: Aug. 16, 2011

(54) LIQUID CRYSTAL DISPLAY HAVING COMPENSATION CIRCUIT FOR REDUCING GATE DELAY

(75) Inventors: Yuan Li, Shenzhen (CN); Xiao-Jin Qi, Shenzhen (CN)

(73) Assignees: Innocom Technology (Shenzhen) Co., Ltd., Shenzhen, Guangdong Province (CN); Chimei Innolux Corporation, Miao-Li County (TW)

( * ) Notice: Subject to any disclaimer, the term of this patent is extended or adjusted under 35 U.S.C. 154(b) by 928 days.

(21) Appl. No.: 11/986,380

(22) Filed: Nov. 21, 2007

(65) Prior Publication Data

US 2008/0117155 A1 May 22, 2008

(30) Foreign Application Priority Data

Nov. 21, 2006 (TW) ..... 95143001 A

(51) Int. Cl.
*G09G 3/36* (2006.01)

(52) U.S. Cl. ..... 345/87; 345/92; 345/98; 345/100

(58) Field of Classification Search ..... 345/87, 345/88, 92, 93, 94, 98, 100, 204, 211
See application file for complete search history.

(56) References Cited

U.S. PATENT DOCUMENTS

| | | | | |
|---|---|---|---|---|
| 6,862,013 | B2 * | 3/2005 | Takeuchi et al. | 345/92 |
| 7,133,034 | B2 | 11/2006 | Park et al. | |
| 2002/0011982 | A1 | 1/2002 | Takeuchi et al. | |
| 2003/0210220 | A1 * | 11/2003 | Hebiguchi | 345/100 |
| 2005/0030273 | A1 * | 2/2005 | Shih et al. | 345/94 |
| 2006/0103618 | A1 * | 5/2006 | Miura | 345/96 |

FOREIGN PATENT DOCUMENTS

TW 564325 B 12/2003

* cited by examiner

*Primary Examiner* — Alexander Eisen
*Assistant Examiner* — Mark Regn
(74) *Attorney, Agent, or Firm* — Altis Law Group, Inc.

(57) ABSTRACT

An exemplary liquid crystal display (400) includes a liquid crystal panel (430), a gate driving circuit (410), a data driving circuit (420), and a compensation circuit (440). The liquid crystal panel includes a plurality of gate lines (401) and a plurality of data lines (402) intersecting with the gate lines. The gate driving circuit is configured for providing a plurality of scanning signals to the gate lines in sequence. The data driving circuit is configured for providing a plurality of gray scale voltages to the data lines. The compensation circuit is configured for compensating the scanning signals. The compensation circuit is charged by alternate of the scanning signals, and discharges each such charge to provide a compensation signal to a gate line corresponding to a next scanning signal.

10 Claims, 4 Drawing Sheets

LIQUID CRYSTAL DISPLAY HAVING COMPENSATION CIRCUIT FOR REDUCING GATE DELAY

FIELD OF THE INVENTION

The present invention relates to liquid crystal displays (LCDs) having compensation circuits for reducing gate delays.

GENERAL BACKGROUND

LCDs are being used in more and more different applications. One trend is that LCDs are becoming bigger in size to suit certain new uses. This means such kind of LCD has a larger viewing area and high definition. LCDs employing thin film transistors (TFTs) are called TFT-LCDs. Generally, TFT-LCDs are prone to have a problem of gate delay due to the elongated gate lines therein, and an associated problem of gate delay phenomenon of scanning signals transmitted therein. Gate delay usually results in image flickering or other display problems.

Referring to FIG. 4, a typical LCD 100 includes a gate driving circuit 110, a data driving circuit 120, and a liquid crystal panel 130. The gate driving circuit 110 is configured for providing a plurality of scanning signals to the liquid crystal panel 130, and the data driving circuit 120 is configured for providing a plurality of gray scale voltages to the liquid crystal panel 130.

The liquid crystal panel 130 includes a plurality gate lines 101 which are parallel to each other, a plurality of data lines 102 which are parallel to each other and which intersect the gate lines 101, a plurality of TFTs 103 arranged at crossings of the gate lines 101 and the data lines 102, a plurality of pixel electrodes 104, and a plurality of common electrodes 105 generally opposite to the pixel electrodes 104. Each of areas bounded by two adjacent gate lines 101 and two adjacent data lines 102 is defined as a pixel area. The gate driving circuit 110 sequentially outputs a plurality of scanning signals to the gate lines 101. The data driving circuit 120 applies a plurality of gray scale voltages to source electrodes 1032 (see FIG. 5) of corresponding TFTs 103 when a corresponding gate line 101 is scanned.

Referring also to FIG. 5, an equivalent circuit diagram of a pixel area is shown. A gate electrode 1031 of the TFT 103 is connected to the corresponding gate line 101, the source electrode 1032 of the TFT 103 is connected to the corresponding data line 102, and a drain electrode 1033 of the TFT 103 is connected to the corresponding pixel electrode 104. Because the gate line 101 has a certain inherent resistance R, and a parasitic capacitance Cgd is generated between the gate electrode 1031 and the drain electrode 1033, a resistance-capacitance (RC) delay circuit is formed at the pixel area. In one gate line 101, therefore, many such RC delay circuits are connected in series. The RC delay circuits can delay the scanning signals applied to the gate line 101, and thus the waveform of the scanning signal can be distorted.

Referring also to FIG. 6, this shows scanning signal waveforms provided at two ends of one of the gate lines 101. One end is adjacent to the gate driving circuit 110, and the other end is far from the gate driving circuit 110. "Vg1" is the waveform of the scanning signal at the end of the gate line 101 that is adjacent to the gate driving circuit 110, and "Vg2" is the waveform of the scanning signal at the end of the gate line 101 that is far from the gate driving circuit 110. That is, the waveform "Vg2" is a distorted waveform of the scanning signal, due to delaying by the serial RC delay circuits. "Von" denotes a turn-on voltage of the TFTs 103 along the gate line 101, and "Voff" denotes a turn-off voltage of the TFTs 103 along the gate line 101. Because of the distortion of the waveform of the scanning signal, the turning on of a TFT 103 at the end of the gate line 101 far away from the gate driving circuit 110 is delayed. For example, the delay may be a time period "t" seconds, as shown in FIG. 3. That is, an on-state period of TFTs 103 far from the gate driving circuit 110 is shorter than it should be.

Because a gray scale voltage will not be applied to the drain electrode until the corresponding TFT 103 is turned on, the TFT 103 which is far from the gate driving circuit 110 is not properly charged with the gray scale voltage. Thus, the image display is deteriorated in the corresponding pixel area. Typically, many pixel areas are affected because the corresponding TFTs 103 lack proper charging of gray scale voltages. In this case, the image of the LCD 100 has flickers.

What is needed, therefore, is a liquid crystal display which can overcome the above-described deficiencies.

SUMMARY

An exemplary liquid crystal display includes a liquid crystal panel, a gate driving circuit, a data driving circuit, and a compensation circuit. The liquid crystal panel includes a plurality of gate lines and a plurality of data lines intersecting with the gate lines. The gate driving circuit is configured for providing a plurality of scanning signals to the gate lines in sequence. The data driving circuit is configured for providing a plurality of gray scale voltages to the data lines. The compensation circuit is configured for compensating the scanning signals. The compensation circuit is charged by alternate of the scanning signals, and discharges each such charge to provide a compensation signal to a gate line corresponding to a next scanning signal.

Other novel features and advantages of the liquid crystal display will become more apparent from the following detailed description when taken in conjunction with the accompanying drawings.

DETAILED DESCRIPTION OF PREFERRED EMBODIMENTS

Reference will now be made to the drawings to describe preferred and exemplary embodiments of the present invention in detail.

Figure 1:
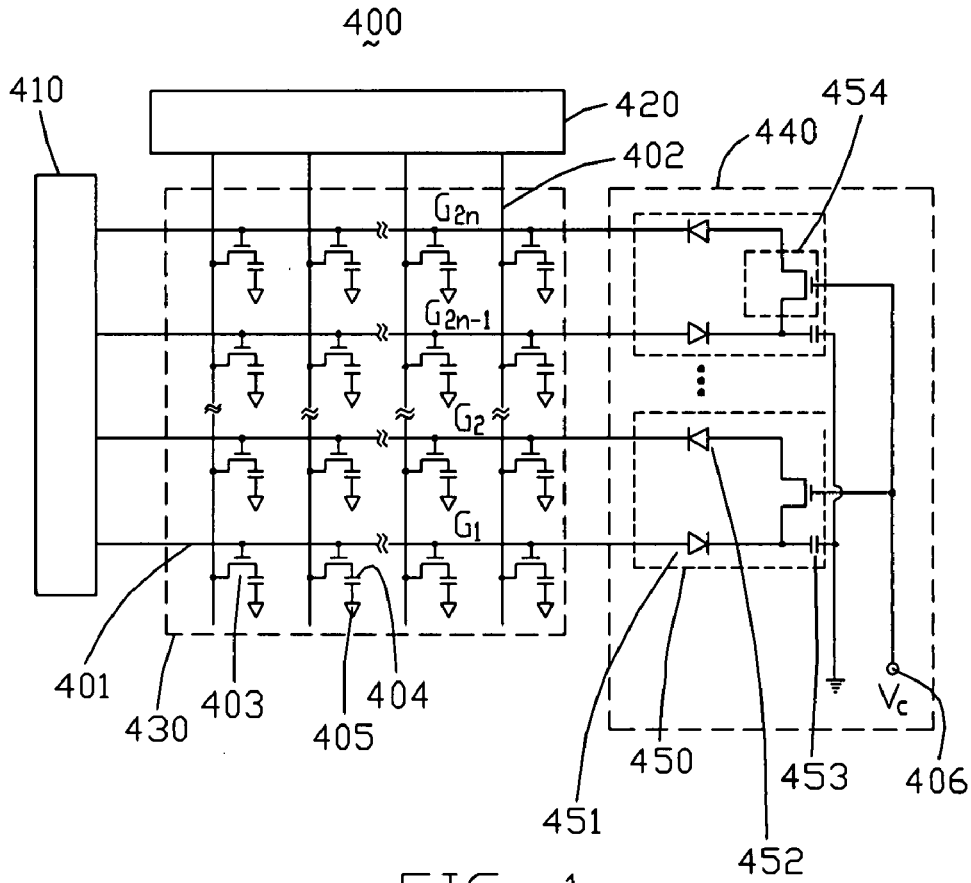
FIG. 1 is essentially an abbreviated circuit diagram of a liquid crystal display according to a first embodiment of the present invention.

Referring to FIG. 1, a circuit diagram of a liquid crystal display 400 according to a first embodiment of the present invention is shown. The liquid crystal display 400 includes a gate driving circuit 410, a data driving circuit 420, a liquid crystal panel 430, and a compensation circuit 440. The gate driving circuit 410 is configured for providing a plurality of scanning signals to the liquid crystal panel 430, and the data driving circuit 420 is configured for providing a plurality of gray scale voltages to the liquid crystal panel 430. The compensation circuit 440 is configured for providing a plurality of compensation signals to the liquid crystal panel 430.

The liquid crystal panel 430 includes a plurality gate lines 401 (G1~G2*n*, where n is a natural number) which are parallel to each other, a plurality of data lines 402 which are parallel to each other and which intersect the gate lines 401, a plurality of TFTs 403 arranged at crossings of the gate lines 401 and the data lines 402, a plurality of pixel electrodes 404, and a plurality of common electrodes 405 generally opposite to the pixel electrodes 404. Each of areas bounded by two adjacent gate lines 401 and two adjacent data lines 402 is defined as a pixel area. One end of each gate line 401 is connected to the gate driving circuit 410, and an opposite end of each gate line 401 is connected to the compensation circuit 440. The data lines 402 are connected to the data driving circuit 420.

The TFTs 403 each include a gate electrode (not labeled) connected to the corresponding gate line 401, a source electrode (not labeled) connected to the corresponding data line 402, and a drain electrode (not labeled) connected to the corresponding pixel electrode 404. The gate driving circuit 410 sequentially outputs a plurality of scanning signals to the gate lines 401. The data driving circuit 420 applies a plurality of gray scale voltages to source electrodes of the corresponding TFTs 403 when each gate line 401 is scanned.

The compensation circuit 440 includes a plurality of compensation units 450 (P1~Pn), and a voltage input terminal 406. The compensation units 450 each include a first diode 451, a second diode 452, a capacitor 453, and a switching TFT 454. For the compensation unit Pi ($1 \leqq i \leqq n$), a gate electrode of the switching TFT 454 is connected to the input terminal 406. A source electrode of the switching TFT 454 is connected to the gate line G2*m*−1 ($1 \leqq m \leqq n$) via positive and negative electrodes of the first diode 451, and is connected to ground via the capacitor 453. A drain electrode of the switching TFT 454 is connected to the gate line G2*m* via the positive and negative electrodes of the second diode 452. That is, the compensation unit Pi is coupled with two adjacent gate lines G2*m*−1 and G2*m*. The input terminal 406 is configured to receive a control signal Vc. The control signal Vc has the same amplitude as the scanning signal provided by the gate driving circuit 410. Such amplitude can be defined by a low level voltage Vgl and a high level voltage Vgh. Vgl can be a grounding voltage, and Vgh should exceed a turn-on voltage of the switching TFT 454.

When a scanning signal is applied to the gate line G2*m*−1 from the gate driving circuit 410, the switching TFT 454 is turned off by the control signal Vc. The scanning signal charges the capacitor 453 via the diode 451.

When a scanning signal is applied to the gate line G2*m* from the gate driving circuit 410, the control signal Vc turns on the corresponding switching TFT 454. The capacitor 453 discharges and applies a high level compensation signal to the gate line G2*m* via the switching TFT 454 and the diode 452. Because the compensation signal is applied to the gate line G2*m* from the compensation circuit 440, the compensation signal and the scanning signal are applied in different directions. The compensation signal and the scanning signal are both applied to the gate line G2*m*. Thus, when the scanning signal applied to the TFTs 403 is far away from the gate driving circuit 410, the scanning signal can be compensated by the compensation signal such that the on-state period of the TFTs 403 far from the gate driving circuit 410 is essentially equal to the on-state period of the TFTs 403 near the gate driving circuit 410.

Figure 2:
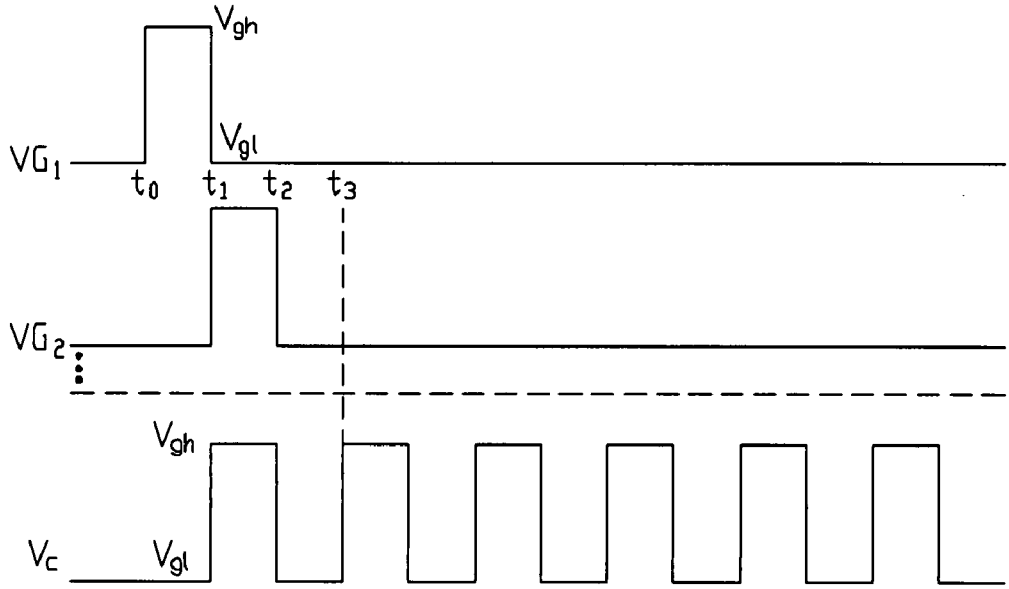
FIG. 2 is a sequence waveform of driving signals of the liquid crystal display of FIG. 1.

Referring also to FIG. 2, a plurality of waveforms of scanning signals of the liquid crystal display 400 are shown. "VG1" and "VG2" represent the scanning signals applied to the gate lines G1 and G2, respectively.

During a period t0~t1, the gate driving circuit 410 applies the scanning signal VG1 to the gate line G1, and the corresponding switching TFT 454 is in an off-state. The capacitor 453 is charged by the scanning signal.

During a period t1~t2, the gate driving circuit 410 applies the scanning signal VG2 to the gate line G2, and the switching TFT 454 is turned on by the control signal Vc. The capacitor 453 discharges and therefore applies a high-level compensation signal to the gate line G2 via the source electrode and drain electrode of the on-state switching TFT 454. Thus, the scanning signal applied to the gate line G2 is compensated by the high-level compensation signal, and a gate delay of the scanning signal is reduced.

Other processes occurring during the above-described period t0~t2 are as follows. When the gate line 401 connected to the first diode 451 of the corresponding compensation unit 450 is scanned, the capacitor 453 of the compensation unit 450 is charged. When the gate line 401 connected to the second diode 452 of the compensation unit 450 is scanned thereafter, the capacitor 453 of the compensation unit 450 is discharged, and a high-level compensation signal is applied to the gate line 401 connected to the second diode 452 of the compensation unit 450. Thus the period of activation of a TFT 403 far from the gate driving circuit 410 is not delayed, and can be generally equal to the period of activation of a TFT 403 on the same gate line 401 close to the gate driving circuit 410. Therefore, each TFT 403 connected to the same gate line 401 can have substantially the same activation period. Therefore the LCD 400 can avoid any flicker phenomenon that might otherwise occur.

Figure 3:
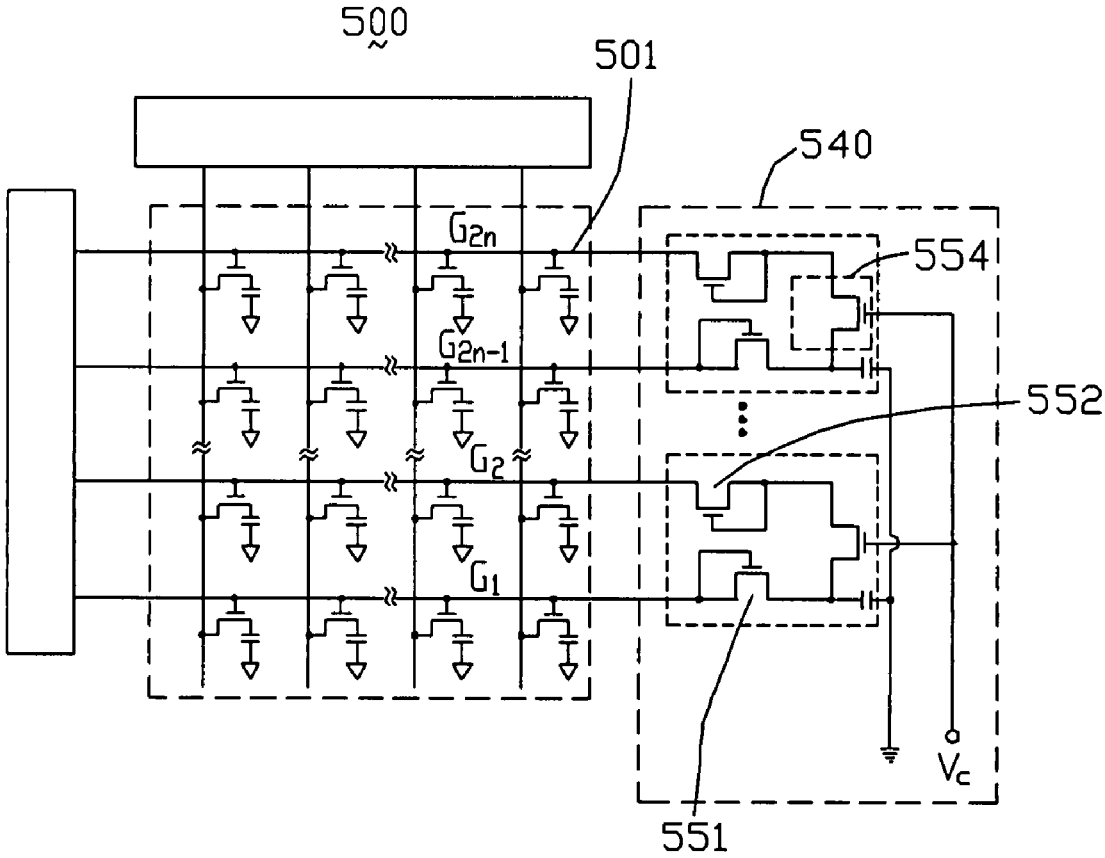
FIG. 3 is essentially an abbreviated circuit diagram of a liquid crystal display according to a second embodiment of the present invention.
Figure 4:
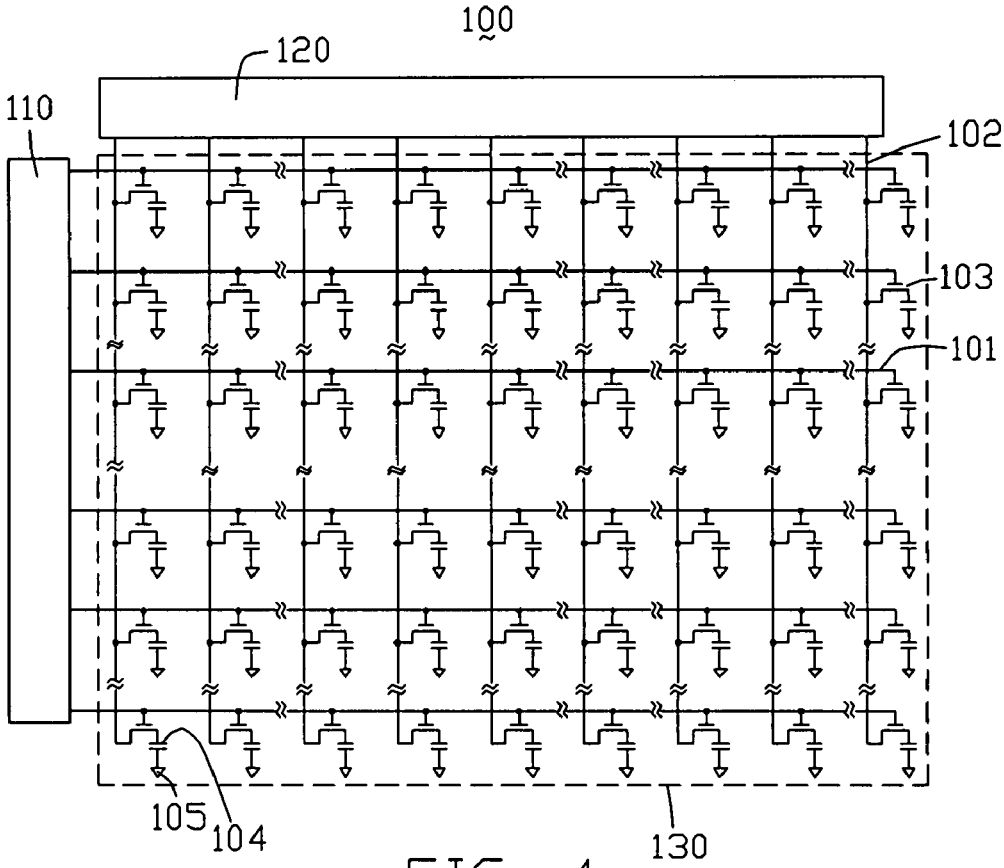
FIG. 4 (RELATED ART)
FIG. 4 is essentially an abbreviated circuit diagram of a conventional liquid crystal display, the liquid crystal display including a liquid crystal panel, the liquid crystal panel including a plurality of pixel areas.
Figure 5:
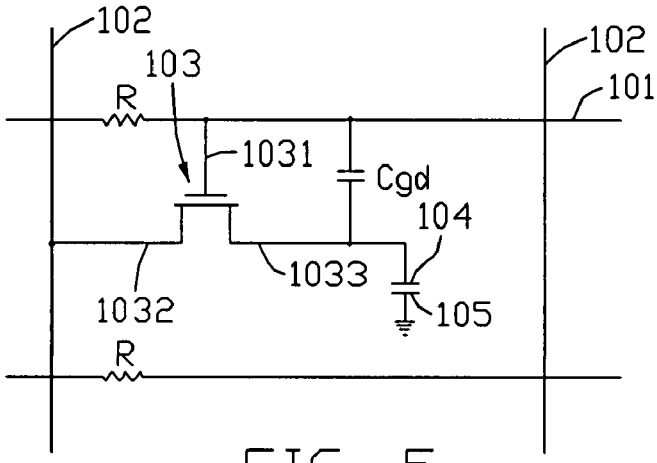
FIG. 5 (RELATED ART)
FIG. 5 is an equivalent circuit diagram of one of the pixel areas of FIG. 3.
Figure 6:
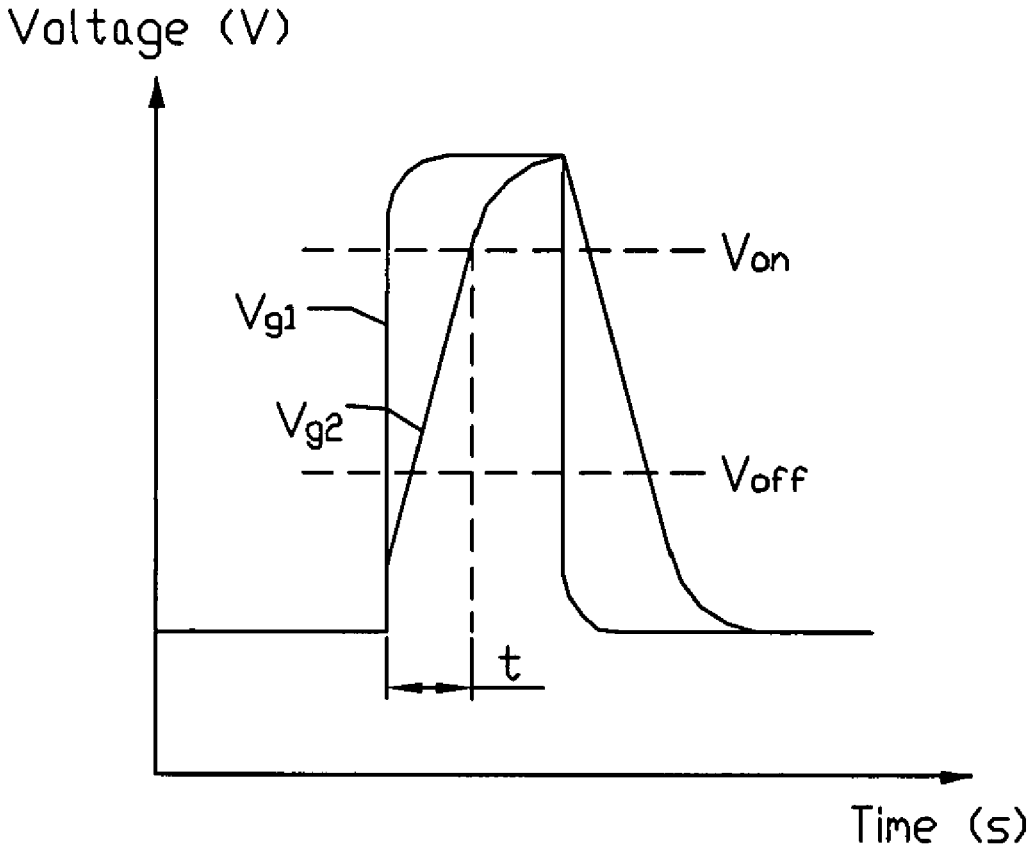
FIG. 6 (RELATED ART)
FIG. 6 is a voltage-time graph relating to the liquid crystal display of FIG. 4, illustrating a gate delay phenomenon.

Referring to FIG. 3, a circuit diagram of a liquid crystal display 500 according to a second embodiment of the present invention is shown. The liquid crystal display 500 is similar to the liquid crystal display 400. However, the liquid crystal display 500 includes a compensation circuit 540. Each compensation unit (not labeled) of the compensation circuit 540 includes a first metal-oxide-semiconductor field effect transistor (MOSFET) 551 and a second MOSFET 552 respectively. In detail, a gate electrode of the first MOSFET 551 is connected to a source electrode of the first MOSFET 551. The source electrode of the first MOSFET 551 serves as a signal input terminal. A gate electrode of the second MOSFET 552 is connected to a source electrode of the second MOSFET 552. The source electrode of the second MOSFET 552 serves as a signal input terminal. Drain electrodes of the MOSFETs 551, 552 serve as signal outputs, respectively. In particular, the drain electrode of the first MOSFET 551 is connected to the source electrode of a switching TFT 554; and the drain electrode of the second MOSFET 552 is connected to a corresponding gate line 501.

Other alternative embodiments can include the following. In one example, the LCD 400 can include a plurality of gate lines 401 (G1~G2*n*+1, where n is a natural number).

It is to be further understood that even though numerous characteristics and advantages of preferred and exemplary embodiments have been set out in the foregoing description, together with details of the structures and functions of the embodiments, the disclosure is illustrative only; and that changes may be made in detail, especially in matters of shape, size, and arrangement of parts within the principles of the present invention to the full extent indicated by the broad general meaning of the terms in which the appended claims are expressed.

What is claimed is:

1. A liquid crystal display comprising:

a liquid crystal panel comprising a plurality of gate lines parallel to each other, and a plurality of data lines parallel to each other and intersecting the gate lines;

a gate driving circuit configured for providing a plurality of scanning signals to the gate lines in sequence;

a data driving circuit configured for providing a plurality of gray scale voltages to the data lines; and a compensation circuit configured for compensating the scanning signals, wherein the compensation circuit comprises a plurality of compensation units and a control signal input for receiving a control signal, each compensation unit being connected to two adjacent gate lines and comprising a first diode, a second diode, a capacitor, and a switching transistor, one gate line of the two adjacent gate lines being connected to a positive electrode of the first diode, a negative electrode of the first diode being connected to ground via the capacitor, a gate electrode of the switching transistor being connected to the control signal input, a source electrode of the switching transistor being connected to the negative electrode of the first diode, and a drain electrode of the switching transistor being connected to the other one gate line of the two adjacent gate lines via a positive electrode and a negative electrode of the second diode, wherein the two adjacent gate lines are scanned successively, when the one gate line is scanned, the switching transistor is switched off and the capacitor is charged only by the scanning signal of the one gate line via the first diode and obtains electric energy, when the other one gate line is scanned, the switching transistor is switched on, the capacitor only applies the electric energy obtained from the scanning signal of the one gate line to the other one gate line via the switching transistor and the second diode for reduce a gate delay of the scanning signal of the other one gate line.

2. The liquid crystal display in claim 1, wherein the plurality of gate lines are gate lines numbered G1 through G2n, n being a natural number, the gate lines being sequentially scanned by the scanning signals.

3. The liquid crystal display in claim 2, wherein the two adjacent gate lines are a (G2m-1)th gate line and a (G2m)th gate line, the one gate line being the (G2m-1)th gate line, the other one gate line being the (G2m)th gate line, m being a natural number, and $1 \leqq m \leqq n$.

4. The liquid crystal display in claim 1, wherein the liquid crystal panel further comprises a plurality of thin film transistors arranged at crossings of the gate lines and the data lines.

5. The liquid crystal display in claim 1, wherein each gate line comprises a front end and a tail end, the front ends of the gate lines being connected to the gate driving circuit for receiving the scanning signals, and the tail ends of the gate lines being connected to the compensation units.

6. A liquid crystal display comprising:

a liquid crystal panel comprising a plurality of gate lines parallel to each other, and a plurality of data lines parallel to each other and intersecting the gate lines;

a gate driving circuit configured for providing a plurality of scanning signals to the gate lines in sequence;

a data driving circuit configured for providing a plurality of gray scale voltages to the data lines; and a compensation circuit configured for compensating the scanning signals, wherein the compensation circuit comprises a plurality of compensation units and a control signal input for receiving a control signal, each compensation unit being connected to two adjacent gate lines and comprising a first transistor, a second transistor, a capacitor, and a switching transistor, a gate electrode of the first transistor being connected to a source electrode of the first transistor, a gate electrode of the second transistor being connected to a source electrode of the second transistor, one gate line of the two adjacent gate lines being connected to the source electrode of the first transistor, a drain electrode of the first transistor being connected to ground via the capacitor, a gate electrode of the switching transistor being connected to the control signal input, a source electrode of the switching transistor being connected to the drain electrode of the first transistor, and a drain electrode of the switching transistor being connected to the other one gate line of the two adjacent gate lines via the source electrode and a drain electrode of the second transistor, wherein the two adjacent gate lines are scanned successively, when the one gate line is scanned, the switching transistor is switched off and the capacitor is charged only by the scanning signal of the one gate line via the first transistor and obtains electric energy, when the other one gate line is scanned, the switching transistor is switched on, the capacitor only applies the electric energy obtained from the scanning signal of the one gate line to the other one gate line via the switching transistor and the second transistor for reduce a gate delay of the scanning signal of the other one gate line.

7. The liquid crystal display in claim 6, wherein the plurality of gate lines are gate lines numbered G1 through G2n, n being a natural number, the gate lines being sequentially scanned by the scanning signals.

8. The liquid crystal display in claim 7, wherein the two adjacent gate lines are a (G2m-1)th gate line and a (G2m)th gate line, the one gate line being the (G2m-1)th gate line, the other one gate line being the (G2m)th gate line, m being a natural number, and $1 \leqq m \leqq n$.

9. The liquid crystal display in claim 6, wherein each gate line comprises a front end and a tail end, the front ends of the gate lines being connected to the gate driving circuit for receiving the scanning signals, and the tail ends of the gate lines being connected to the compensation units.

10. The liquid crystal display in claim 6, wherein the first transistor, the second transistor and the switching transistor are metal oxide semiconductor field effect transistors.

* * * * *